US006138436A

United States Patent [19]

Malin et al.

[11] Patent Number: 6,138,436

[45] **Date of Patent: *Oct. 31, 2000**

[54] FEEDING OF HORIZONTAL FORM-FILL-AND-SEAL ZIPPER MACHINE

[75] Inventors: Art Malin, Northbrook; David J. Matthews, Gilman, both of Ill.

[73] Assignee: Illinois Tool Works, Inc., Glenview, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 09/244,523

[22] Filed: Feb. 4, 1999

Related U.S. Application Data

[63] Continuation-in-part of application No. 09/014,906, Jan. 28, 1998.

[51] Int. Cl.[7] ..... B65B 9/00

[52] U.S. Cl. ..... 53/133.4; 53/139.2; 53/550; 53/450

[58] Field of Search ..... 53/450, 550, 133.3, 53/133.4, 139.2

[56] References Cited

U.S. PATENT DOCUMENTS

| | | | |
|---|---|---|---|
| 3,274,746 | 9/1966 | James et al. | 53/22 |
| 3,339,337 | 9/1967 | Rapp et al. | 53/180 |
| 3,958,390 | 5/1976 | Pringle, Jr. et al. | 53/112 |
| 4,589,145 | 5/1986 | Van Erden et al. | 383/5 |
| 4,876,842 | 10/1989 | Ausnit | 53/410 |
| 5,092,831 | 3/1992 | James et al. | 493/394 |
| 5,505,037 | 4/1996 | Terminella et al. | 53/133.4 |
| 5,511,359 | 4/1996 | Kenney | 53/413 |
| 5,557,907 | 9/1996 | Malin et al. | 53/139.2 |
| 5,564,259 | 10/1996 | Stolmeier | 53/410 |
| 5,603,202 | 2/1997 | Hanagata | 53/550 |
| 5,649,409 | 7/1997 | Gujer et al. | 53/461 |
| 5,672,234 | 9/1997 | Rodenstein et al. | 156/494 |
| 5,687,549 | 11/1997 | Jostler et al. | 53/450 |
| 5,706,635 | 1/1998 | Simmons | 53/511 |

*Primary Examiner*—Joseph J. Hail, III
*Assistant Examiner*—William Hong
*Attorney, Agent, or Firm*—Pitney, Hardin, KIpp & Szuch LLP

[57] ABSTRACT

In a horizontal form-fill-and-seal (FFS) machine, a continuous length of packaging film is folded lengthwise over the consumer products to be packaged. The lateral edges of the packaging film are separately and independently aligned with one another by edge sensing and control devices. A zipper is in place or fed between the aligned lateral edges of the packaging film. The lateral edges are sealed to one another, and the zipper, if unattached, is sealed to the folded packaging film. Side seals are produced by conventional apparatus, which also separate completed packages from one another. Apparatus for driving the packaging film though the machine in a balanced and symmetrical manner are also provided.

17 Claims, 8 Drawing Sheets

FEEDING OF HORIZONTAL FORM-FILL-AND-SEAL ZIPPER MACHINE

CROSS REFERENCE TO RELATED APPLICATIONS

This is a continuation-in-part (CIP) of Ser. No. 09/014,906 filed on Jan. 28, 1998, the disclosure of which is incorporated herein by reference.

BACKGROUND OF THE INVENTION

1. Field of the Invention

The present invention relates to reclosable plastic bags of the type in which perishable food products and other goods are packaged for sale to consumers in retail outlets. More specifically, the present invention relates to reclosable plastic bags which are concurrently manufactured and filled with a consumer product on a horizontal form-fill-and-seal (FFS) machine, wherein a plastic interlocking zipper for each bag is disposed longitudinally relative to the direction of motion of the thermoplastic sheet material used to form the reclosable bags on the FFS machine.

2. Description of the Prior Art

The present invention relates to improvements in the package-making art and may be practiced in the manufacture of thermoplastic bags and packages of the kind that may be used for various consumer products, but which are particularly useful for food products which must be kept in moisture- and air-tight packages, free from leakage until initially opened for access to the product contents, which packages are then reclosable by zipper means to protect any remainder of the product therein.

The indicated art is fairly well-developed, but nevertheless remains open to improvements contributing to increased efficiency and cost effectiveness.

The present invention relates more particularly to the production of reclosable plastic bags which are concurrently manufactured and filled with a consumer product on a horizontal FFS machine. In this regard, U.S. Pat. No. 4,589,145 shows a method of and apparatus for packaging a block-shaped product, such as cheese, into a wrapped envelope package, with material especially adapted for said packaging, wherein a bottom face of the product article is engaged on a panel area of the wrapper sheet, which sheet has extended portions that are wrapped about the article and sealed across the top face of the article. One of the portions of the wrapper sheet has a reclosable zipper and a web portion alongside the zipper which is adapted to be severed or ruptured to provide a mouth opening for access to the article within the package, the mouth opening being reclosable by the enclosed zipper. The zipper may be provided with structure to prevent its being pulled open during the wrapping and sealing of the wrapper about the article. The web portion may have guidance for severing or rupturing the same when access into the package is desired.

In U.S. Pat. No. 4,876,842, another method of and apparatus for packaging product masses in an FFS machine, wherein a continuous length of packaging film is joined in running relation by a continuous length of separately formed plastic reclosable fastener assembly having interlock profile strips spot-sealed together at package-length intervals, are shown. The co-running fastener strip assembly and the packaging film are oriented so that the spot seals of the strip are located in alignment with the spaces between the product masses on the film to ensure that the fastener strip assembly will be cross-sealed at the spot seals when the film is cross sealed between the product masses to provide individual packages. The orienting may be effected by an indexing arrangement including sensor response to index marks on the film and the fastener assembly.

The present invention is an improvement over those disclosed in these prior-art U.S. patents.

SUMMARY OF THE INVENTION

The present invention relates to a horizontal form-fill-and-seal (FFS) machine for packaging consumer products, and more specifically to means for and a method of driving the packaging material through the FFS machine in a balanced and symmetrical fashion.

A horizontal FFS machine in accordance with the present invention comprises means, such as a supply roll, for providing a continuous length of packaging film having two lateral edges for use in packaging the products, and means for placing the consumer products to be packaged at intervals along one half of the continuous length of packaging film.

The horizontal FFS machine also includes means for folding the continuous length of packaging film continuously down the center thereof and over upon the consumer products, and means for aligning the lateral edges of the folded continuous length of packaging film with one another. Means for feeding a zipper between the aligned lateral edges of the packaging film are also included.

A zipper sealing section includes means for sealing the aligned lateral edges of the continuous length of packaging film to one another, and means for sealing the zipper within the folded packaging film.

Means for sealing the folded-packaging film at intervals between the consumer products to create individual packages, and for separating the individual packages from one another, are also a part of the machine.

In a package produced on a horizontal FFS machine in accordance with the present invention, the lateral edges of the packaging film are sealed together to form a package with a seal at one side thereof and the various sealing and cutting devices act only at that one side as the packaging film is driven through the machine. This could be problematic, however, in that the forces acting on the packaging film are unbalanced and the packaging film thus has a tendency to move laterally in an uncontrolled manner.

This is not a problem in typical prior art horizontal FFS machines, since a fin seal is placed generally in the middle of the package, which fin seal provides a symmetrical means for driving the packaging film through the machine. Because the fin seal is centrally located, the forces which act on the packaging film are balanced, and thus there is no lateral movement of the packaging material.

The present invention thus relates particularly to a means for and method of driving the packaging film through the horizontal FFS machine in a balanced and symmetrical fashion wherein the packages are sealed at a lateral edge, as opposed to the center thereof.

In a first embodiment, two pairs of heated drive rollers are provided on either side of the packaging film, which rollers seal the packages at opposite sides thereof and drive the packaging film through the machine. In a second embodiment, a pair of drive rollers are provided on either side of the packaging film directly following the sealing of the zipper and film. In a third embodiment, a series of drive rollers are provided in a conveyor to provide for symmetrical and positive driving. In a fourth embodiment, the zipper is preapplied to the package material and a series of drive rollers are provided in a conveyor to provide for symmetrical and positive driving.

The present invention will now be described in more complete detail with frequent reference being made to the figures identified below.

DETAILED DESCRIPTION OF THE PREFERRED EMBODIMENT

Figure 1:
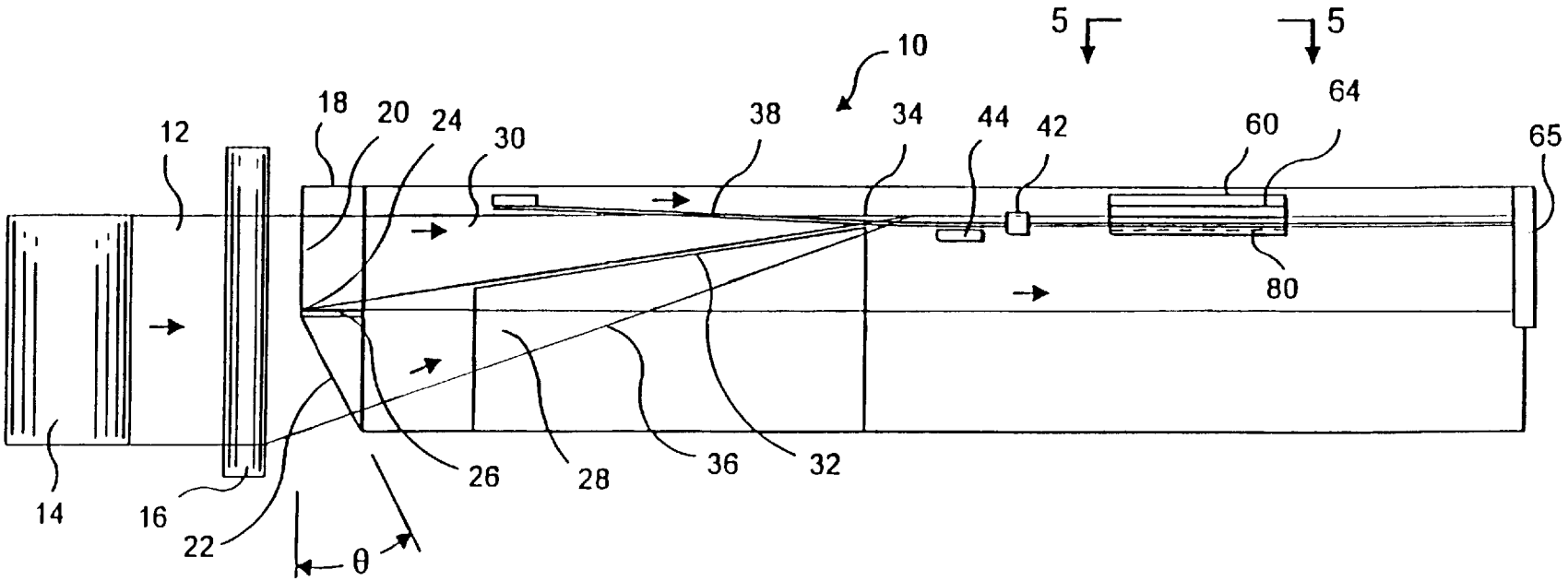
FIG. 1 is a top schematic plan view of the horizontal FFS machine of the present invention.
Figure 2:
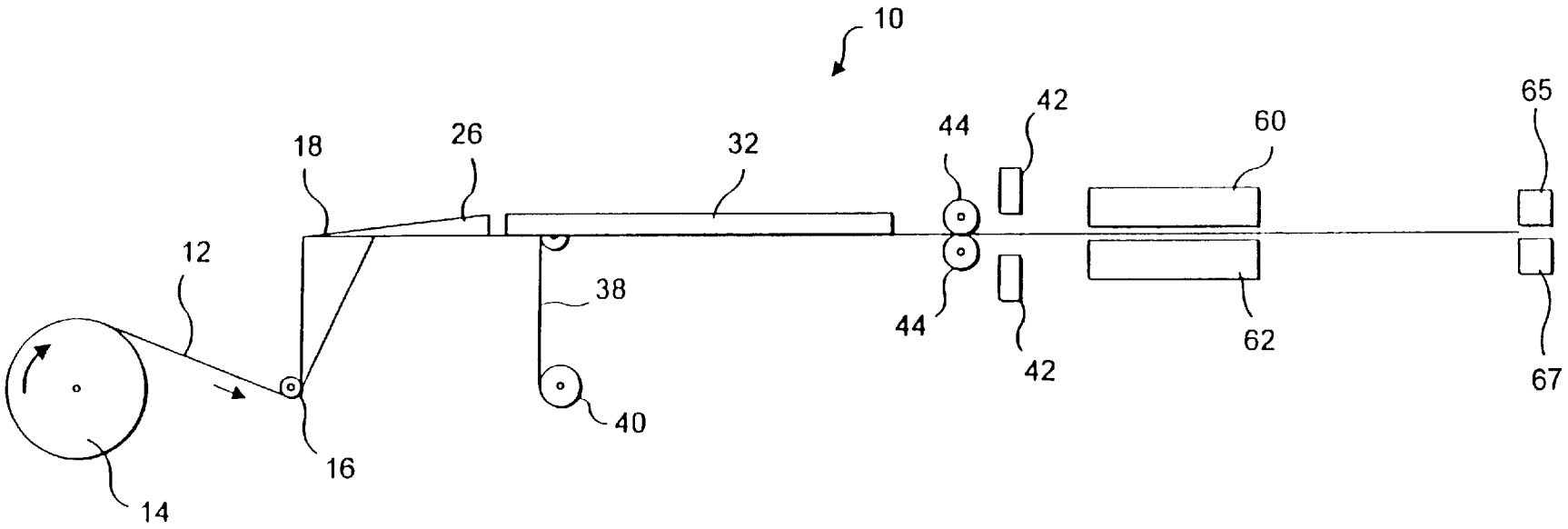
FIG. 2 is a side schematic plan view of the machine.

Referring to FIGS. 1 and 2, which are top and side schematic plan views, respectively, of a horizontal FFS machine 10, a continuous length of packaging film 12, which may comprise polyethylene, is dispensed from a supply roll 14 downward under a guide roll 16 and upward toward a fold-forming member 18.

The fold-forming member 18 includes a first fold-forming edge 20, which is in a direction transverse to the running direction of the packaging film 12, and a second fold-forming edge 22, which makes an oblique angle, Θ, between 15° and 30 ° with respect the direction of the first fold-forming edge 20. Angle Θ is between 15° and 30to properly control the lateral movement of the film 12 and to minimize the length of the machine 10. The apex 24 formed where the first fold-forming edge 20 meets the second fold-forming edge 22 coincides, more or less, with the center of the packaging film 12, which is continuously folded lengthwise down the middle by the horizontal FFS machine 10. Passage of the packaging film 12 over the apex 24 begins the folding process.

Disposed on the fold-forming member 18 in a direction perpendicular thereto is a wedge-shaped member 26. The wedge-shaped member 26 essentially raises the portion 28 of the packaging film 12 being folded over upward relative to the portion 30 lying flat on the horizontal FFS machine 10. This is done so that a consumer product to be packaged may be placed on the portion 30 on or near the fold-forming member 18, and eventually be covered by the portion 28 being folded over.

A folding guide 32 is disposed downstream from the fold-forming member 18 and at an oblique angle relative to the running direction of the packaging film 12. The folding guide 32 continuously folds portion 28 of the packaging film 12 over onto portion 30, so that, ultimately, the two lateral edges 34,36 of the packaging film 12 may align with one another, and the packaging film 12 itself may be C-folded continuously in a lengthwise direction.

A zipper 38, comprising a male zipper profile interlocked with a female zipper profile and of a variety well-known to those of ordinary skill in the art, is continuously fed and guided between the two overlapped lateral edges 34,36 of the packaging film 12 from a supply reel 40.

Downstream from the point where the two lateral edges 34,36 first overlap one another, are two edge sensing and control devices. In a preferred embodiment, each edge sensing and control device comprises a photo cell 42 and a steerable guide wheel 44, one edge sensing and control device being provided each of the two lateral edges 34,36. The photo cells 42 accurately sense the locations of the two lateral edges 34,36, and, if there is any departure from the desired location of either of the two lateral edges, signal their respective steerable guide wheels 44 to correct the location.

Figure 4:
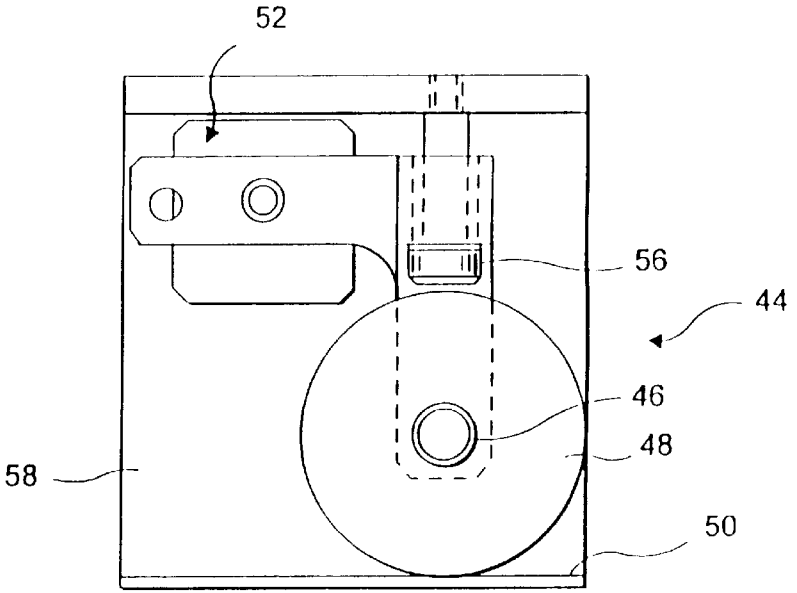
FIG. 4 is a side view of the wheel.
Figure 3:
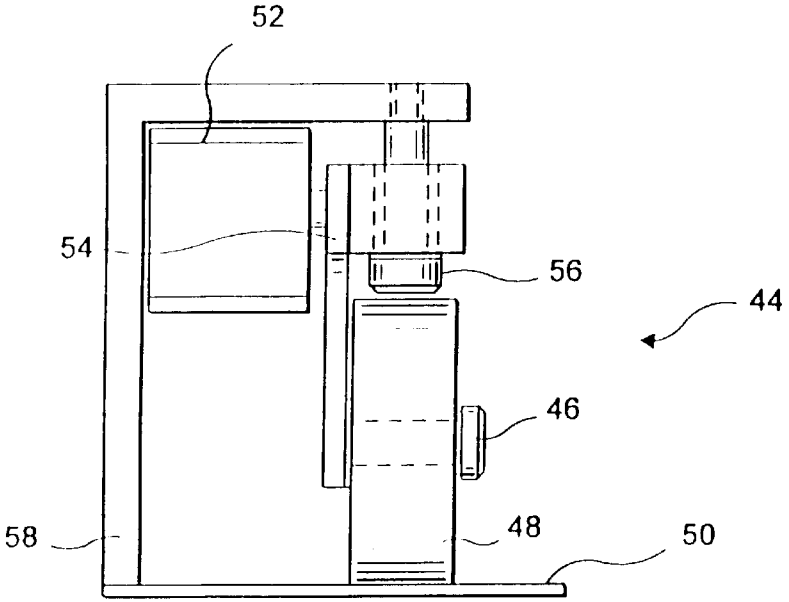
FIG. 3 s a front view of a steerable guide wheel of the horizontal FFS machine.

FIGS. 3 and 4 are front and side views, respectively, of a steerable guide wheel 44. Wheel 44 rotates about a horizontal axis 46, as packaging film 12, clamped between tire 48 and surface 50, moves downstream on the horizontal FFS machine 10. When either of photo cells 42 senses a discrepancy in the desired location of one of the two lateral edges 34,36, cylinder 52, acting upon arm 54, turns the wheel 44 about a vertical axis to move the lateral edge 34,36 in question toward or away from upright member 58.

Figure 5:
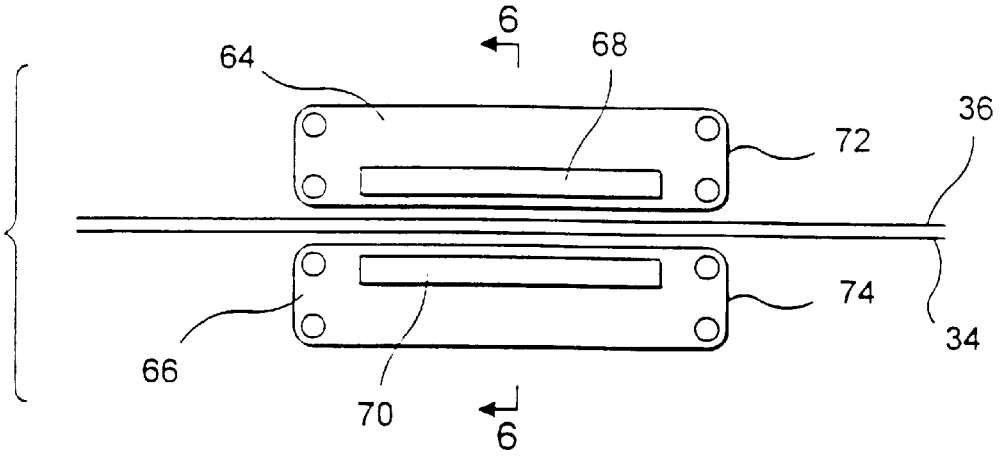
FIG. 5 is a cross-sectional view taken as indicated by line 5—5 in FIG. 1.
Figure 6:
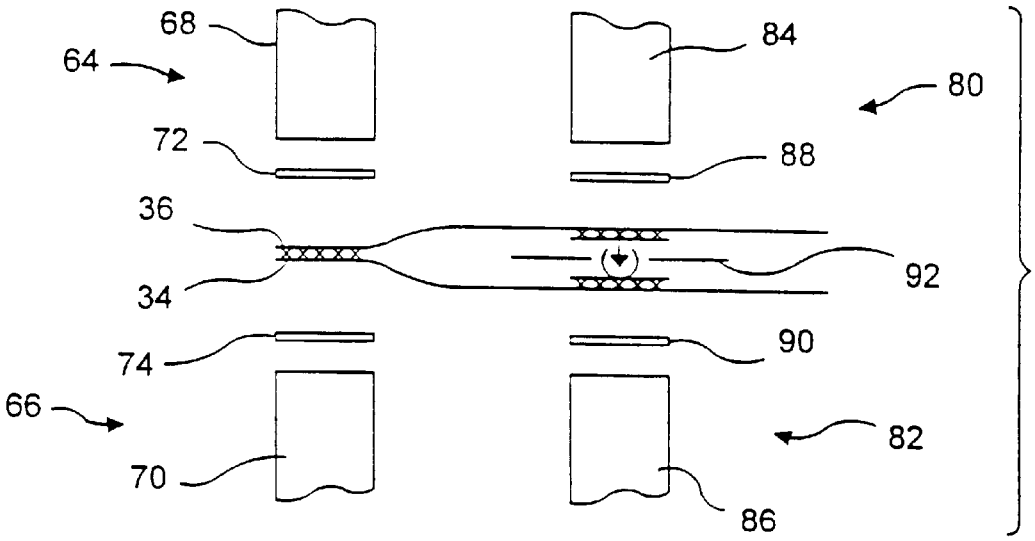
FIG. 6 is a cross-sectional view taken as indicated by line 6—6 in FIG. 5.

Downstream from the two edge sensing and control devices are an upper sealing assembly 60 and a lower sealing assembly 62. Both of the upper and lower sealing assemblies 60,62, as shown in FIGS. 5 and 6, include an edge sealing section and a zipper sealing section aligned in parallel with one another. The sealing sections may be of the type typically used in the prior art. For example, edge sealing sections 64,66 may include stationary heating bars 68,70 surrounded by belts 72,74, respectively, of Kapton- or Teflon-coated material running with the film 12 passing through the edge sealing sections 64,66 to prevent the film from sticking to the stationary heating bars 68,70. Likewise, zipper sealing sections 80,82 may include stationary heating bars 84,86 surrounded by belts 88,90, respectively.

The upper and lower sealing assemblies 60,62 may also be provided with a suitable stationary device 92 to accurately guide and position the zipper 38 between the upper and lower zipper sealing sections 80,82.

Finally, further downstream from the upper sealing assembly 60 and the lower sealing assembly 62 on the horizontal FFS machine 10 are upper and lower cross seal and cut-off jaws 65,67 which separate one package from the next in the usual manner.

As is clear from FIG. 1, the various elements of the horizontal FFS machine act only at one side of the film 12. There is thus a force imbalance as the film 12 advances through the machine, possibly resulting in uncontrolled lateral movement of the film 12. Although the edge sensing and control devices compensate for slight lateral movement of the film edges, they will generally be insufficient to compensate for any large instabilities which may arise during operation of the machine. Thus, it may be desirable to modify the horizontal FFS machine of FIG. 1 so as to eliminate this inherent balance.

Figure 7:
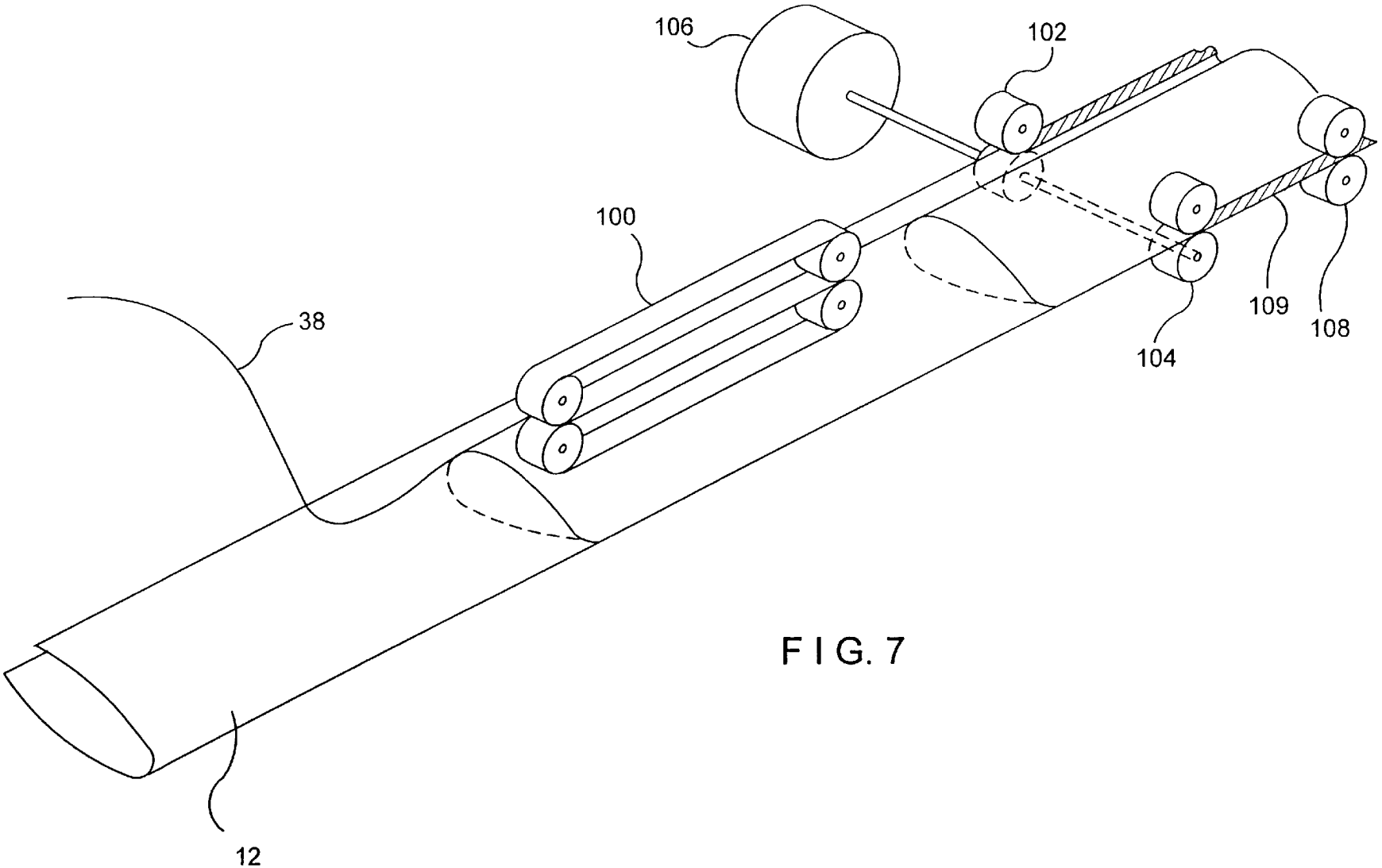
FIG. 7 is a perspective view of a first modification to the horizontal FFS machine of the present invention which provides for metrical driving.

One possible modification is shown in FIG. 7. Unlike in the embodiment of FIG. 1, the zipper sealer 100 is located upstream of the edge sealer 102. The edge sealer 102 is in the form of a pair of heated drive rollers. A second pair of heated drive rollers 104 is provided directly opposite the first pair of heated drive rollers. Both pairs of rollers are driven by a servomotor 106 and together these rollers drive the film 12 through the machine in a balanced and symmetrical manner. A pair of steering rollers 108 may also be provided to compensate for any slight lateral movement of the film. The first pair of heated rollers 102 also seals the lateral edges of the package together, and the second pair of heated rollers 104 seals the film together at crease 109. In this manner both sides of the package are balanced and symmetrical driving is ensured.

Figure 8:
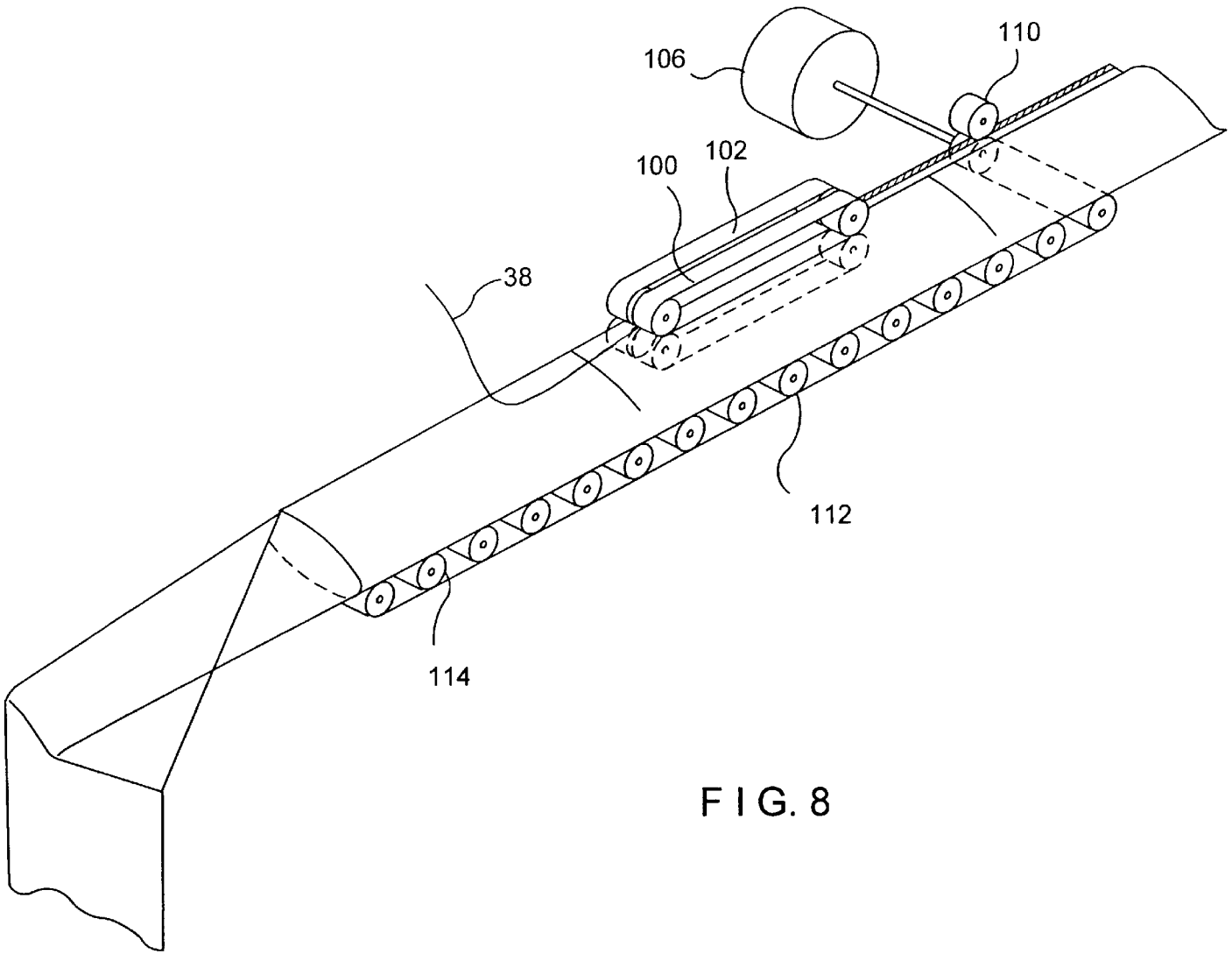
FIG. 8 is a perspective view of a second modification to the horizontal FFS machine of the present invention which provides for syemetrical driving.

A second possible modification is shown in FIG. 8. The zipper sealer 100 is in parallel with the edge sealer 102. A pair of drive rollers 110 which are driven by a servomotor 106 drives the film 12 through the machine and also powers a drive roller conveyor 112 comprised of a series of drive rollers 114. The conveyor 112 ensures that the driving is done in a symmetrical manner by assisting in the driving of the film 12 and by eliminating lateral movement of the film.

Figure 9:
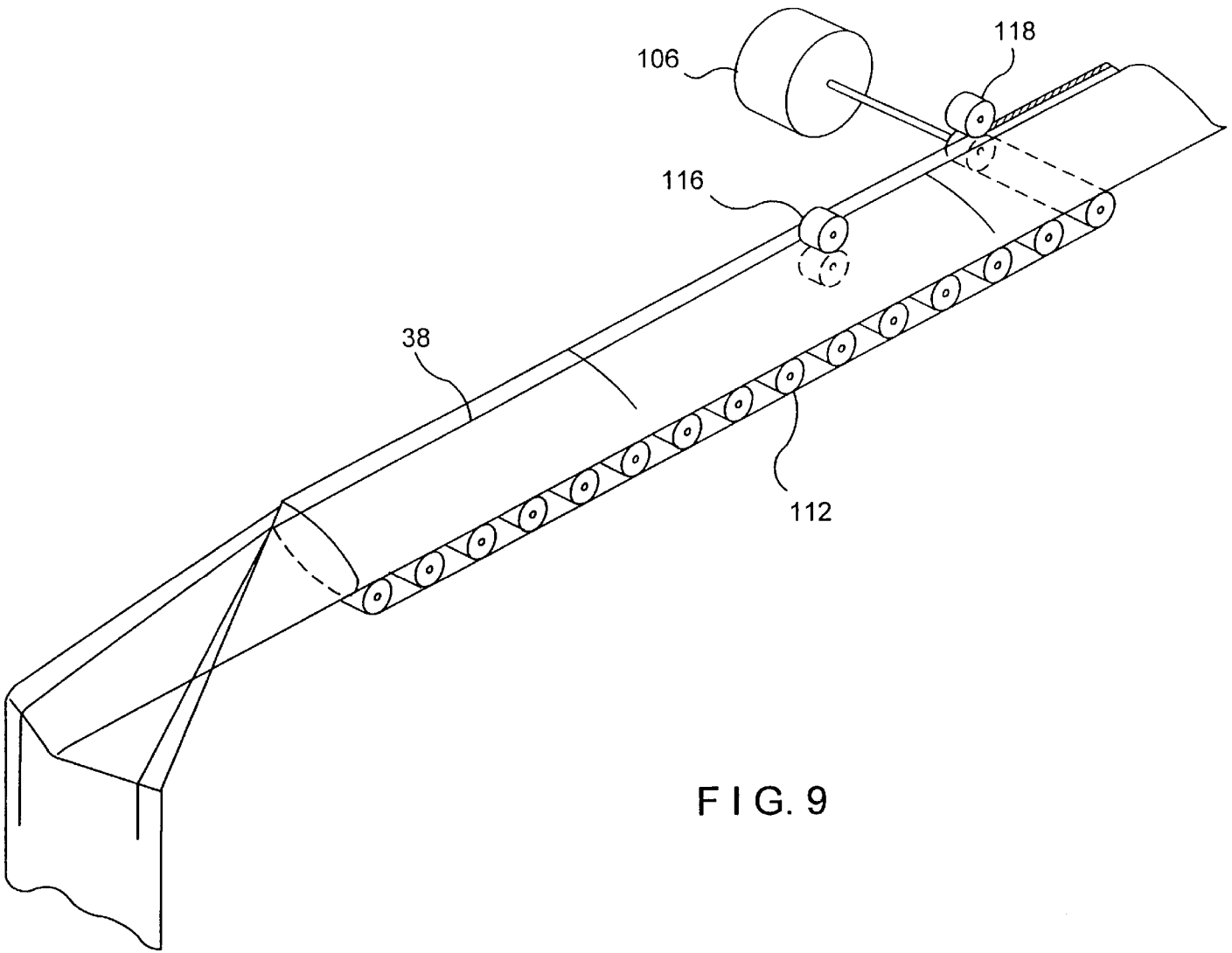
FIG. 9 is a perspective view of a third modification to the horizontal FFS machine of the present invention which provides for symmetrical driving.

A third modification is shown in FIG. 9 and is for the situation where the zipper 38 is preapplied to the film 12. Packaging film with one-half of an interlocked zipper preapplied to opposite lateral edges thereof is well known in the packaging industry and may be purchased from various suppliers. After the film 12 is folded a pair of zipper closing rolls 116 close the zipper as heated drive rollers 118 driven by servomotor 106 drive the film 12 through the machine and seal the lateral edges of the film 12 together. As in the embodiment of FIG. 8, the conveyor 112 ensures that the film is driven in a symmetrical and balanced manner.

Figure 10:
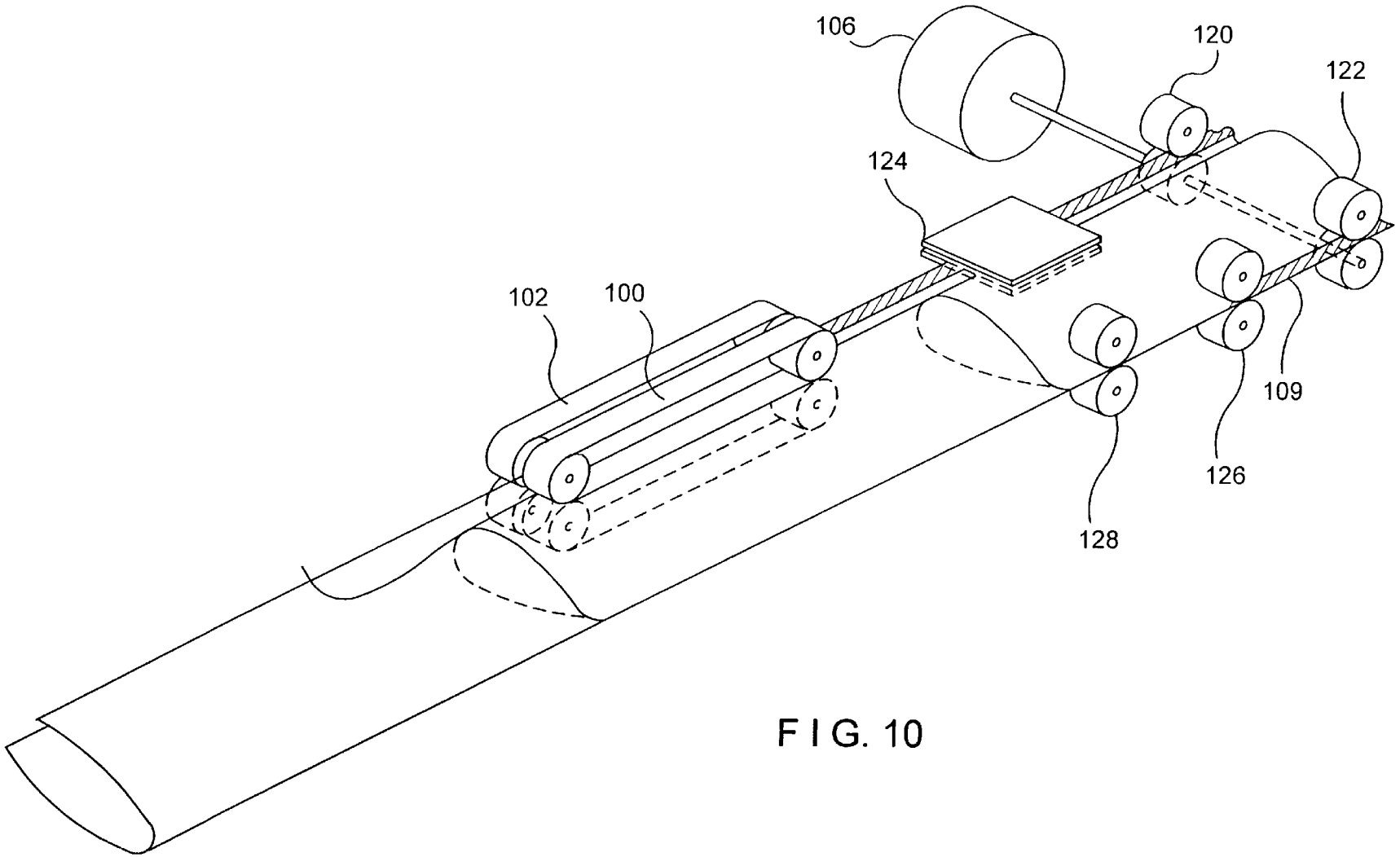
FIG. 10 is a perspective view of a fourth modification to the horizontal FFS machine of the present invention which provides for symmetrical driving.

A fourth modification is shown in FIG. 10. As in FIG. 1, the zipper sealer 100 and the edge sealer 102 are in parallel. Two pairs of drive rollers 120, 122 driven by a servomotor 106 drive the film through the machine. A zipper guide 124 is provided for additional balance and symmetry. A pair of heated rollers 126 are also provided which seals the film at crease 109, thus balancing both sides of the package. A pair of steering rollers 128 may also provided to compensate for any slight lateral movement of the film 12.

Any of the foregoing modifications to the horizontal FFS machine of FIG. 1 will provide balanced and symmetrical driving and improve the overall the operation of the machine.

Modifications to the above would be obvious to those of ordinary skill in the art, yet such modifications would not bring the invention so modified beyond the scope of the appended claims.

We claim:

1. A horizontal form-fill-and seal (FFS) machine comprising:

means for providing a continuous length of packaging film having two lateral edges;

means for placing products to be packaged at intervals along one half of said continuous length of packaging film;

means for folding said continuous length of packaging film continuously down the center thereof and over upon said products to form a first folded side and a second folded side interconnected by a folded section opposite to said lateral edges;

means for aligning said lateral edges of said folded continuous length of packaging film with one another opposite said folded section;

means for feeding a zipper between said aligned lateral edges of said folded continuous length of packaging film;

first drive roller means for contacting and continuously driving said aligned lateral edges; second drive roller means for contacting and continuously driving said folded section;

means for sealing said aligned lateral edges of said folded continuous length of packaging film to one another;

means for sealing said zipper to said folded continuous length of packaging film;

means for sealing said folded continuous length of packaging film crosswise at intervals between said products to create individual packages; and means for separating said individual packages from one another.

2. A horizontal FFS machine as claimed in claim 1 wherein said means for driving comprises:

a first pair of heated drive rollers for driving said folded film through said machine by said aligned lateral edges; and a second pair of heated drive rollers for driving said folded film through said machine by said folded section.

3. A horizontal FFS machine as claimed in claim 2:

wherein said first pair of heated drive rollers seal said aligned film lateral edges together; and wherein said second pair of heated drive rollers seal said film first folded side to said film second folded side at said folded section.

4. A horizontal FFS machine as claimed in claim 2 wherein said means for driving further comprises a pair of steering rollers.

5. A horizontal FFS machine as claimed in claim 1 wherein said first drive roller means comprises:

a pair of drive rollers and further comprising:

a conveyor located upstream of said pair of drive rollers, said conveyor comprising a plurality of rollers driven by said pair of drive rollers.

6. A horizontal FFS machine as claimed in claim 5 wherein said pair of drive rollers is driven by a servomotor.

7. A horizontal FFS machine as claimed in claim 1 wherein said means for driving comprises:

a first pair of drive rollers for driving said folded film through said machine by said aligned lateral edges; and a second pair of drive rollers for driving said folded film through said machine by said folded section.

8. A horizontal FFS machine as claimed in claim 7 wherein said means for driving further comprises a pair of heated rollers for sealing said film first folded side to said film second folded side at said folded section.

9. A horizontal FFS machine as claimed in claim 7 wherein said means for driving further comprises a pair of steering rollers.

10. A horizontal FFS machine as claimed in claim 7 wherein said means for driving further comprises a zipper guide for guiding said zipper after said zipper is sealed to said film.

11. A horizontal form-fill-and seal (FFS) machine comprising:

means for providing a continuous length of packaging film having two lateral edges, each lateral edge having one-half of an interlockable zipper secured thereto;

means for placing products to be packaged at intervals along one half of said continuous length of packaging film;

means for folding said continuous length of packaging film continuously down the center thereof and over upon said products to form a first folded side and a second folded side interconnected by a folded section;

means for interlocking said zipper;

means for sealing said lateral edges of said folded continuous length of packaging film to one another;

first drive roller means for engaging with and continuously driving said folded film by said aligned lateral edges;

second drive roller means for engaging with and continuously driving said folded section;

means for sealing said folded continuous length of packaging film crosswise at intervals between said products to create individual packages; and means for separating said individual packages from one another.

12. A horizontal FFS machine as claimed in claim 11 wherein said zipper interlocking means includes a pair of rollers.

13. A horizontal FFS machine as claimed in claim 11 wherein said first drive roller means for driving includes:

a pair of heated drive rollers which drive said folded film through said machine by said lateral edges; and further comprising:

a conveyor located upstream of said pair of heated drive rollers, said conveyor comprising a plurality of rollers driven by said pair of heated drive rollers.

14. A horizontal FFS machine as claimed in claim 13 wherein said heated drive rollers seal said lateral edges of said film together.

15. A horizontal FFS machine as claimed in claim 13 wherein said heated drive rollers are driven by a servomotor.

16. A method of making reclosable packages on a horizontal form-fill-and seal (FFS) machine comprising the steps of:

providing a continuous length of packaging film having two lateral edges, each lateral edge having one-half of an interlockable zipper secured thereto;

placing products to be packaged at intervals along one half of said continuous length of packaging film;

folding said continuous length of packaging film continuously down the center thereof and over upon said products to form a first folded side and a second folded side interconnected by a folded section;

interlocking said zipper;

aligning said edges and driving said folded film by individually contacting said lateral edges and said folded section;

sealing said lateral edges of said folded continuous length of packaging film to one another;

driving said folded film by said lateral edges and by said folded section;

sealing said folded continuous length of packaging film crosswise at intervals between said products to create individual packages; and separating said individual packages from one another.

17. A method of making reclosable packages on a horizontal FFS machine as claimed in claim 16 wherein said zipper is interlocked by a pair of rollers.

* * * * *